US006494690B2

(12) United States Patent
Seo

(10) Patent No.: US 6,494,690 B2
(45) Date of Patent: Dec. 17, 2002

(54) HERMETIC COMPRESSOR

(75) Inventor: Seung-don Seo, Kwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 09/781,074

(22) Filed: Feb. 8, 2001

(65) Prior Publication Data

US 2002/0051716 A1 May 2, 2002

(30) Foreign Application Priority Data

Aug. 8, 2000 (KR) ..... 2000-45992
Nov. 23, 2000 (KR) ..... 2000-69824

(51) Int. Cl.[7] ..... F04B 35/04

(52) U.S. Cl. ..... 417/415; 417/312; 417/902; 181/403; 181/200

(58) Field of Search ..... 417/312, 415, 417/902; 181/198, 200, 202, 403

(56) References Cited

U.S. PATENT DOCUMENTS 2,963,113 A * 12/1960 Ayling ..... 384/428
3,008,628 A * 11/1961 Gerteis et al. ..... 417/419
3,187,996 A * 6/1965 Roelsgaard ..... 417/312
5,252,038 A * 10/1993 Mangyo et al. ..... 417/902
5,538,404 A * 7/1996 DiFlora et al. ..... 417/312
5,804,775 A * 9/1998 Pinnington ..... 417/312
6,035,963 A * 3/2000 Wollitz ..... 417/902

OTHER PUBLICATIONS

Warren P. Mason, 1964, Academic Press, Physical Acoustics Principles and Methods, vol. 1—Part A, 1 page.*

* cited by examiner

*Primary Examiner*—Charles G. Freay
*Assistant Examiner*—John F Belena
(74) *Attorney, Agent, or Firm*—Westman, Champlin & Kelly, P.A.

(57) ABSTRACT

A hermetic compressor includes an electric drive portion, a compression portion and a casing. The electric drive portion has a rotor and a stator and generates a driving force to compress a refrigerant in the compression portion. The casing encloses the electric drive portion and the compression portion. The compressor further includes a unit process portion formed on an upper portion of the casing. The unit process portion is processed to have a circular or a polygonal shape from a front view. The unit process portion increases a rigidity of the casing, thereby reducing the amount of noise that is generated from the electric drive portion and the compression portion during an operation of the compressor.

11 Claims, 7 Drawing Sheets

FIG. 7

NOISE/VIBRATION COMPARISON

| ITEM | TEST COMPRESSOR | TEST SESSIONS | NOISE LEVEL [dB/A] | VIBRATION LEVEL [G] | | |
|---|---|---|---|---|---|---|
| | | | 48↓ | 0.08↓ | | |
| CONVENTIONAL COMPRESSOR | 6.15cc/REV | n=10 AVG | 47.3 | 0.036 | 0.036 | 0.073 |
| PRESENT INVENTION | 6.15cc/REV | #2 | 45 | 0.028 | 0.029 | 0.068 |
| | | #3 | 43.5 | 0.022 | 0.040 | 0.062 |
| | | #4 | 44.5 | 0.040 | 0.049 | 0.062 |
| | | AVG | 44.3 | 0.030 | 0.039 | 0.064 |

HERMETIC COMPRESSOR

BACKGROUND OF THE INVENTION

1. Field of the Invention

The present invention relates to a hermetic compressor, and more particularly to a hermetic compressor having an improved structure for reducing the noise generated during operation of the compressor.

2. Description of the Related Art

Generally, as shown in FIG. 1, a hermetic compressor includes a sealing case 1, an electric drive portion 10 formed in the case 1, and a compression portion 20. The electric drive portion 10 generates a driving force that reciprocates linearly to compress a refrigerant in the compression portion 20. The electric drive portion 10 includes a rotor 11 and a stator 12.

The case 1 includes a lower shell 1*a* and an upper shell 1*b*. A rotary shaft 14 having an eccentric portion 13 is press fit on the rotor 11. The compression portion 20 includes a cylinder 21 having a suction port 21*a* and a discharge port 21*b*, a piston 22 that linearly reciprocates within the cylinder 21, and a connecting rod 23 disposed between the piston 22 and the eccentric portion 13 of the rotary shaft 14. As the rotary shaft 14 rotates along with the rotor 11, the piston 22 reciprocates within the cylinder 21. The movement of the piston 22 causes the refrigerant to be repeatedly drawn in and discharged through the suction port 21*a* and the discharge port 21*b*.

A compressor having the above structure is usually employed in household refrigerators, and its quality depends mainly on the following two factors: the compression efficiency; and how quiet the compressor is during operation. More specifically, as the compressor operates, various levels of cavity resonance are generated due to the temperature and pressure in the case 1. When the cavity resonance equals the resonance frequency of the case 1, it generates unpleasant sounds, and the compressor vibrates severely. It is evident that such vibration and noise from the compressor affect the quality of the refrigerator. More serious noise is produced from the upper portion of the upper shell 1*b*, which makes high-pitched, metallic, trembling sounds in the high frequency range of 3100 Hz to 3300 Hz. It is noise in this frequency range that has to be particularly controlled.

Because the resonance, which is the main source of the noise, is generated at various frequency ranges, it has been difficult to design a compressor that could prevent noise across a broad range, spanning from the cavity resonance range to resonance frequency range. Recently, the suggestion has been made to vary the thickness of the case 1 to vary the cavity resonance from the resonance frequency range. The suggestion, however, leads to problems, such as difficult and complex design of the compressor and a thicker case 1.

SUMMARY OF THE INVENTION

The present invention has been made to overcome the above-mentioned problems of the related art. Accordingly, it is an object of the present invention to provide a hermetic compressor having an improved structure for reducing noise that is generated during operation of the compressor.

The above object is accomplished by providing a hermetic compressor including an electric drive portion, a compression portion and a casing. The electric drive portion has a rotor and a stator and generates a driving force to compress a refrigerant in the compression portion. The casing encloses the electric drive portion and the compression portion. The compressor further includes a unit process portion formed on an upper portion of the casing. The unit process portion is processed to have a circular or a polygonal shape from a front view. The unit process portion increases a rigidity of the casing, thereby reducing the amount of noise that is generated from the electric drive portion and the compression portion during an operation of the compressor.

BRIEF DESCRIPTION OF THE DRAWINGS

The above objects and other features and advantages of the present invention will become more apparent after a reading of the following detailed description when taken in conjunction with the drawings, in which:

FIG. 7 is a table for showing the comparison of noise reduction effect between a general hermetic compressor and the hermetic compressor in accordance with the second preferred embodiment of the present invention.

DETAILED DESCRIPTION OF PREFERRED EMBODIMENT

A hermetic compressor in accordance with a preferred embodiment of the present invention will be described in greater detail with reference to the accompanying drawings.

Figure 1:
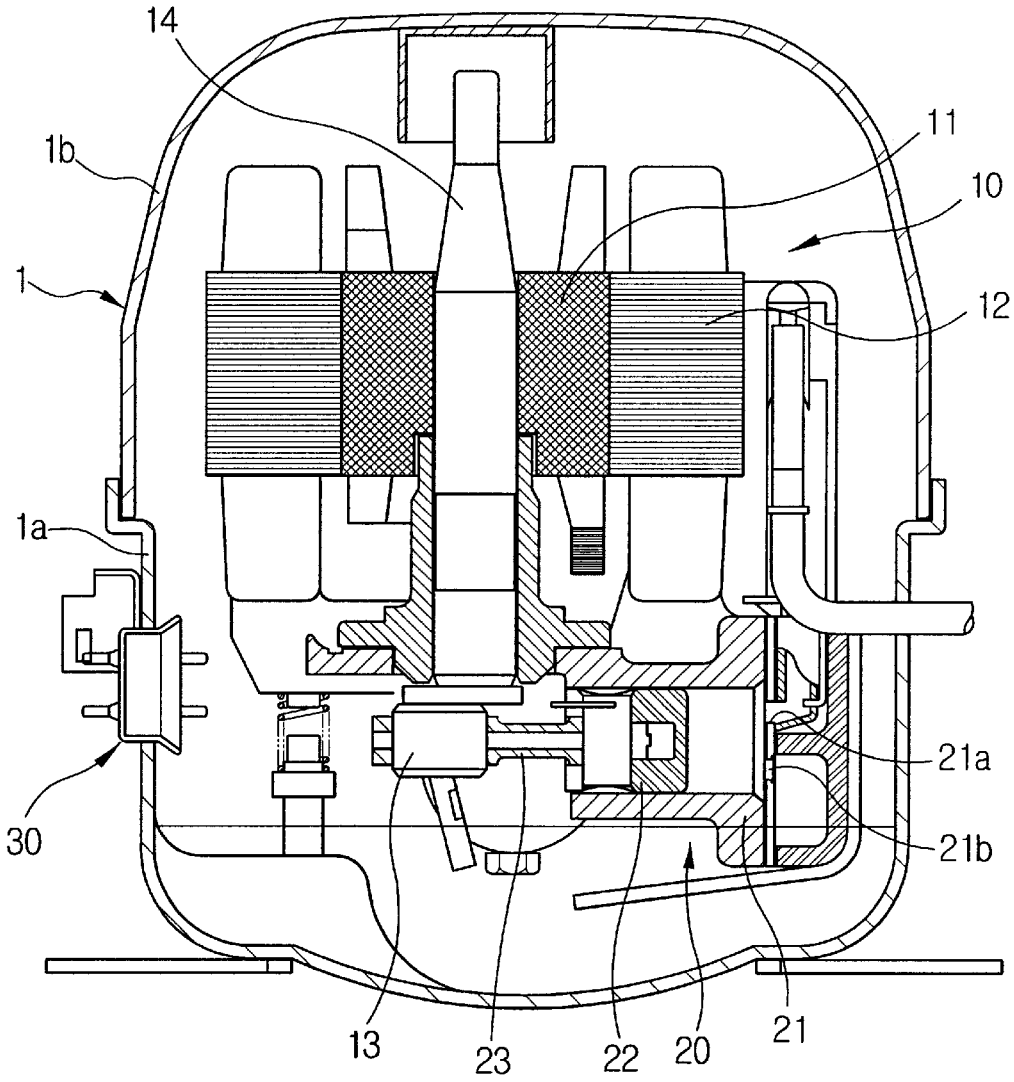
FIG. 1 is a partial sectional view schematically showing a general hermetic compressor.
Figure 2:
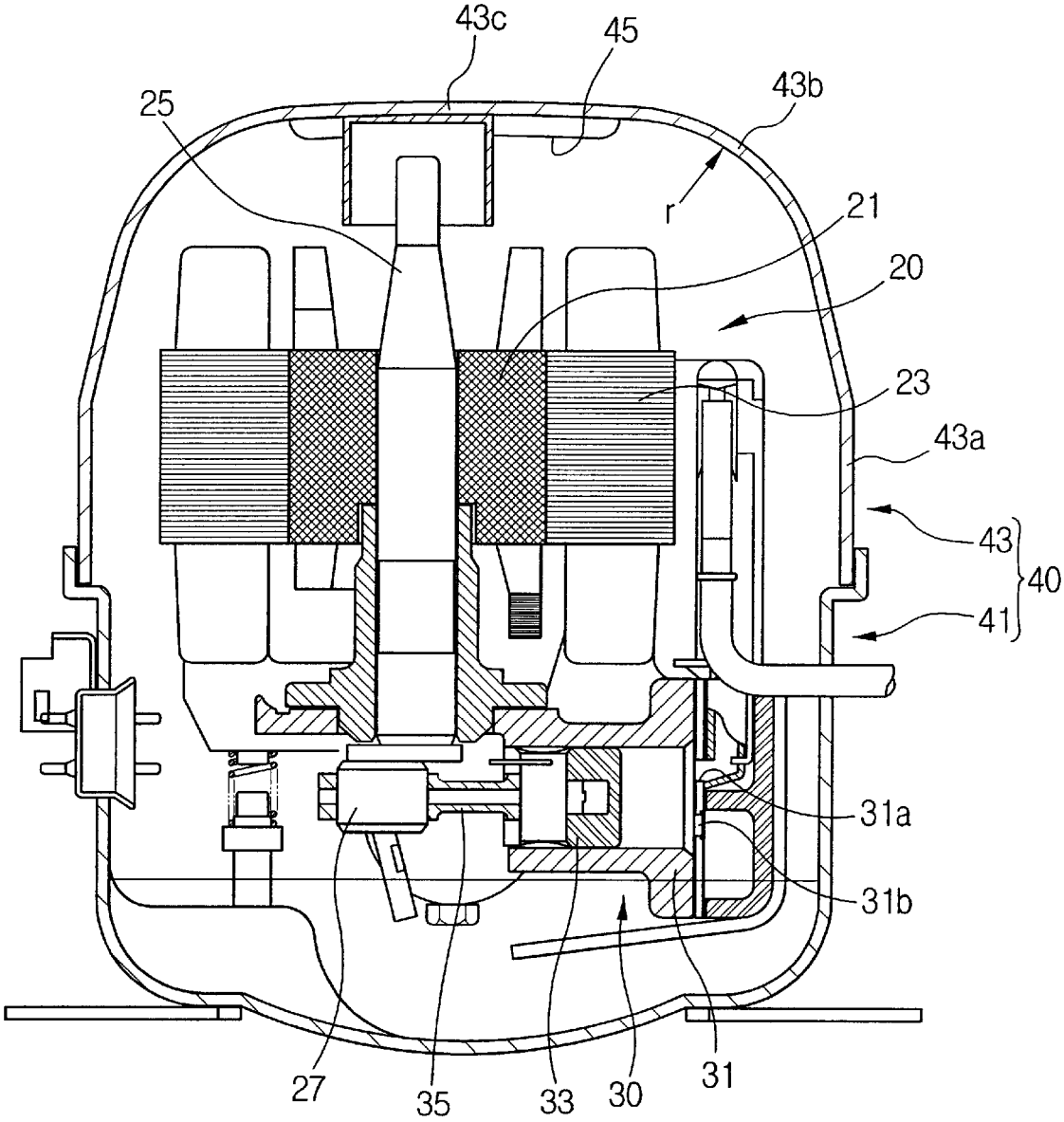
FIG. 2 is a partial sectional view schematically showing a hermetic compressor in accordance with a preferred embodiment of the present invention.

Referring to FIG. 2, the hermetic compressor of the present invention includes an electric drive portion 20 having a rotor 21 and a stator 23, a compression portion 30 for compressing refrigerant, and a case 40 for surrounding and covering the electric drive portion 20 and the compression portion 30. The electric drive portion 20 generates a driving force, which compresses the refrigerant in the compression portion 30.

A rotary shaft 25 is press fit on the middle portion of the rotor 21 and rotates together with the rotor 21. The compression portion 30 includes a cylinder 31 having a suction port 31*a* and a discharge port 31*b*, and a piston 33 that linearly reciprocates within the cylinder 31. The piston 33 is connected to an eccentric portion 27 of the rotary shaft 25 by a connecting rod 35.

The case 40 includes a lower shell 41 and an upper shell 43. The upper shell 43 is connected to the upper portion of the lower shell 41. The lower and upper shells 41 and 43 have a predetermined shape, such as that of a hemisphere, and are usually connected to each other in a symmetrical manner. The upper shell 43 includes a side portion 43*a* of a cylindrical shape, a round portion 43*b* that extends upward from the side portion 43*a*, and an upper portion 43*c* that has of a planar shape. The round portion 43*b* has a predetermined radius of curvature (r) and is connected with the side and upper portions 43*a* and 43*c*, respectively.

Figure 3:
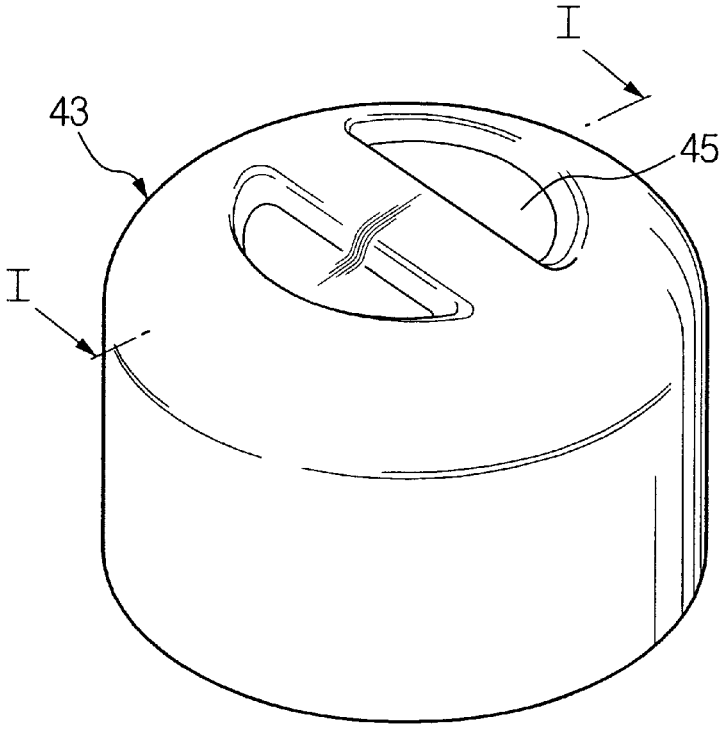
FIG. 3 is a schematic perspective view of the upper shell of FIG. 2.

The upper shell 43 includes a unit process portion 45 formed on the upper shell 43 to increase the rigidity of the upper shell 43 and, in particular, the rigidity of the upper portion 43*c*. The unit process portion 45 is embossed into or from the upper shell 43 by a predetermined depth. As shown in FIG. 3, it is preferable that the unit process portion 45 includes a plurality of half-moon shaped protrusions. The noise reduction effect obtained from the half-moon shaped protrusions has been proven through numeral experiments, and will be described later. It is further preferable that the protrusions of the unit process portion 45 are embossed to a depth ranging from 5 mm to 15 mm. Also, the maximum noise effect is obtained in the protrusion depth range approximately of 7 mm–7.5 mm.

More specifically, by depressing the outer surface of the upper shell 43 to a predetermined depth, the protruding portion 45 protrudes from the inner surface of the upper shell 43.

The unit process portion 45 can also be formed by raising an inner surface of the upper shell 43 upward to a predetermined height. Alternatively, the unit process portion 45 can be a plurality of embossings raised or depressed from the upper shell 43.

Figure 4:
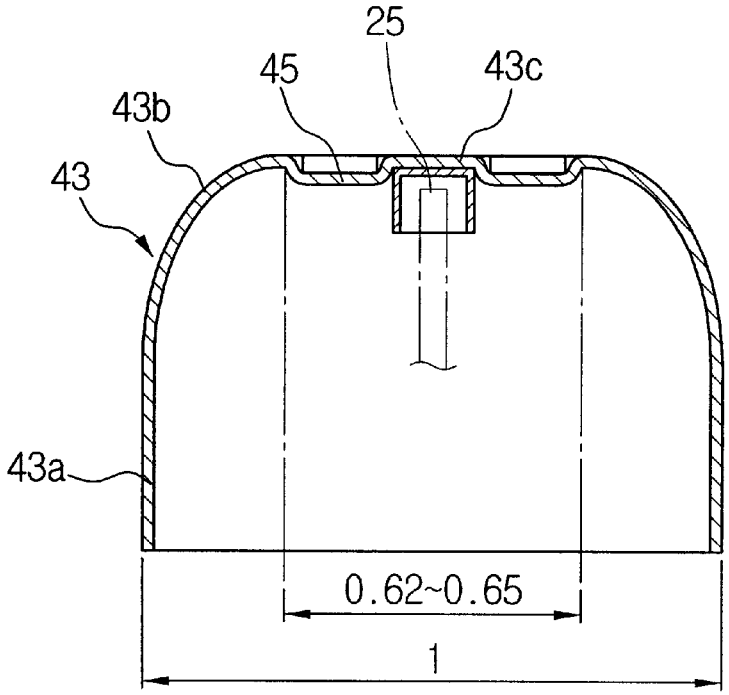
FIG. 4 is a cross-sectional view taken generally along the line I—I of FIG. 3.

Further, as shown in FIG. 4, the protrusions of the protruding portion 45 are symmetrically formed around the rotary shaft 25, and further in an uniform distribution in the direction of the rotation of the rotary shaft 25.

Further by way of example, as shown in FIG. 4, the upper shell 43 has a diameter of 1, as a reference value, at the side portion 43*a*. It is preferable that the protrusions are formed within the distance range of 0.62–0.65. For example, if the diameter of the upper shell 43 at the side portion 43*a* is approximately 157 mm, the distance between the end of one protrusion and the end of a protrusion opposite to that protrusion across the rotary shaft 25 becomes 100 mm. Then, in consideration of the available size of the compressors on the market, it is preferable that the protrusions of the protruding portion 45 are formed within a diameter of 50 mm around the rotary shaft 25.

Figure 6:
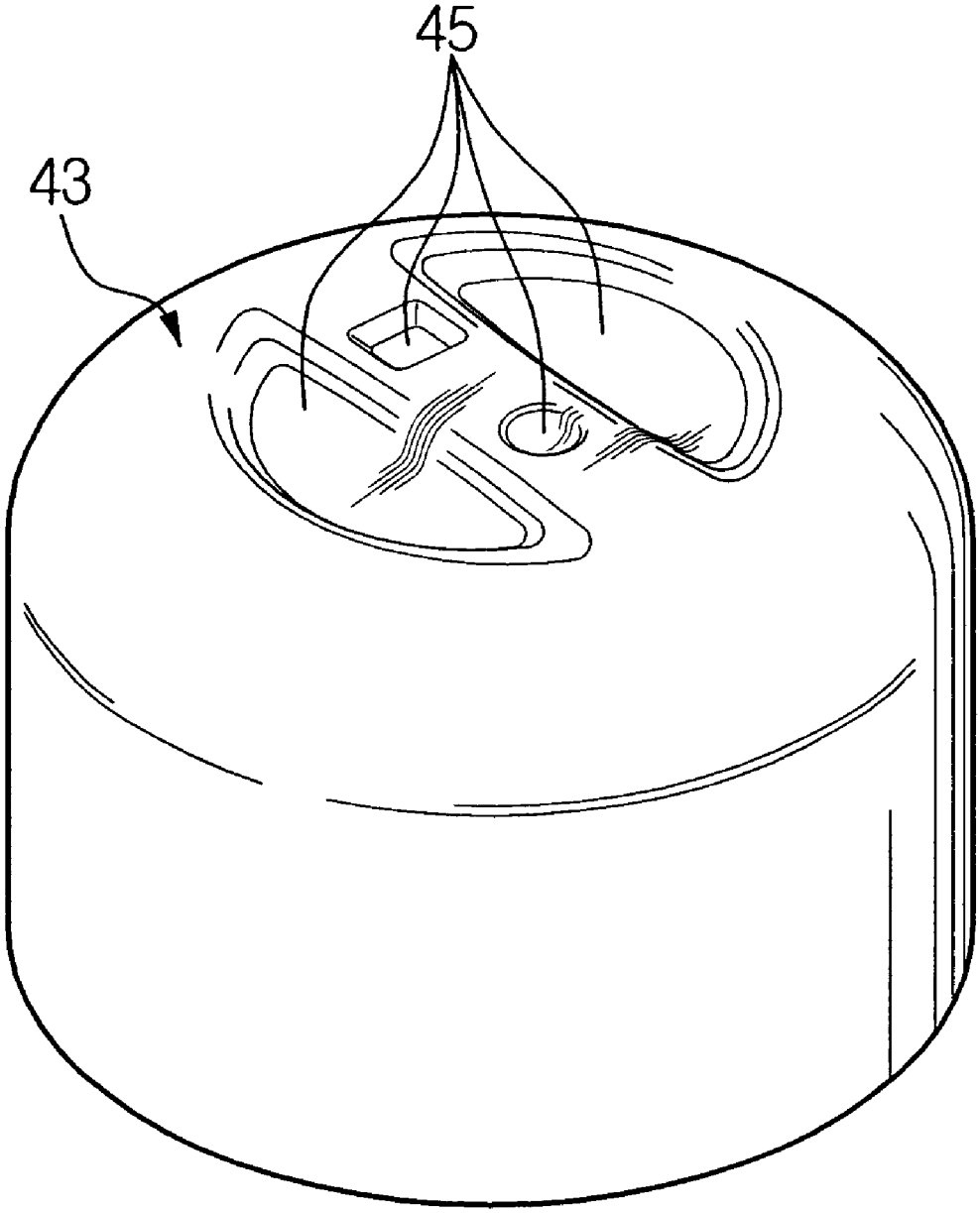
FIG. 6 is a perspective view schematically showing an upper shell of a compressor in accordance with the second preferred embodiment of the present invention.
Figure 8:
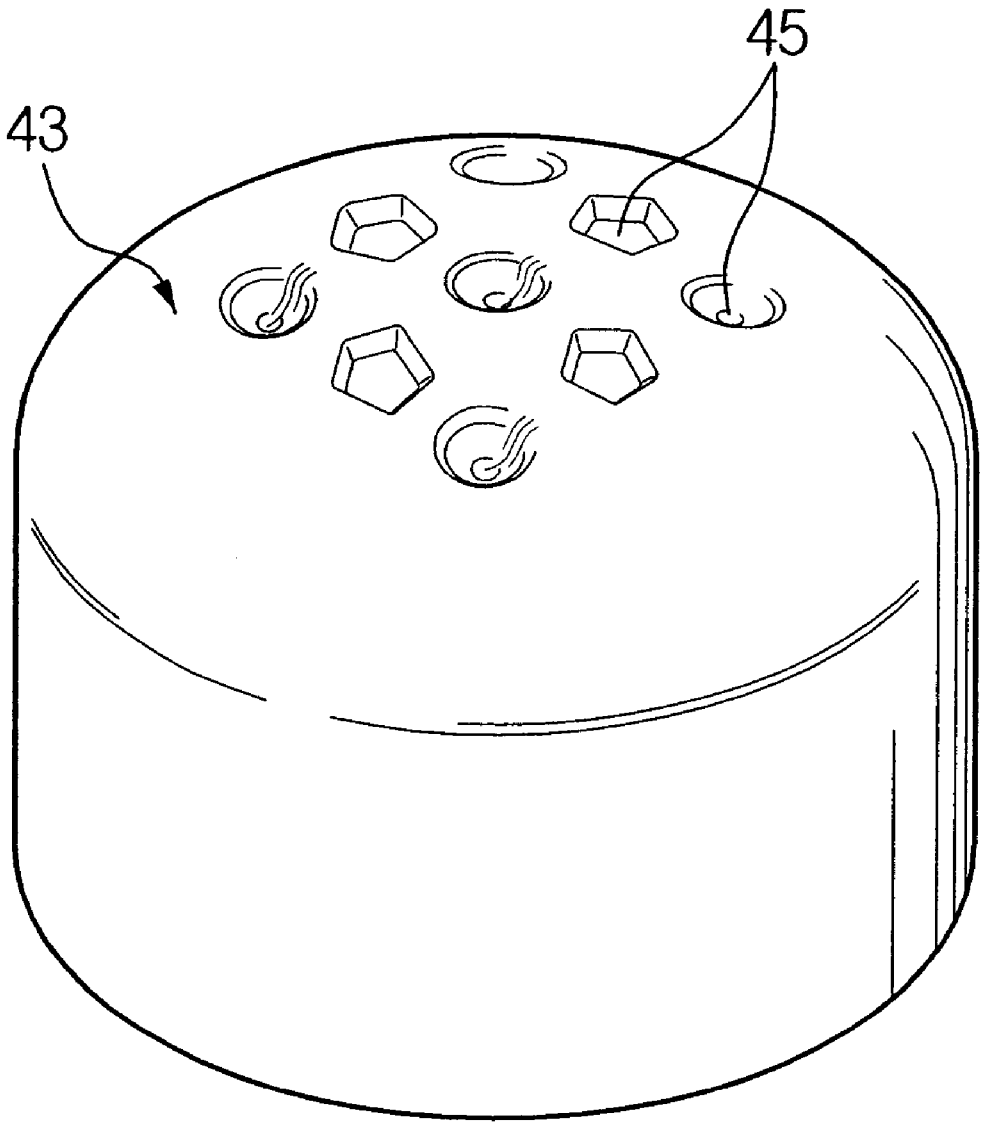
FIG. 8 is a perspective view showing an upper shell of a compressor in accordance with the third preferred embodiment of the present invention.

Meanwhile, according to an aspect of the present invention, as shown in FIGS. 6 and 8, it is preferable that the unit process portion 45 includes a plurality of circular or polygonal shaped portions—when viewed from a front view—in certain patterns.

The noise reduction effect of the hermetic compressor of the present invention will be described below in comparison with a conventional hermetic compressor.

Figure 5:
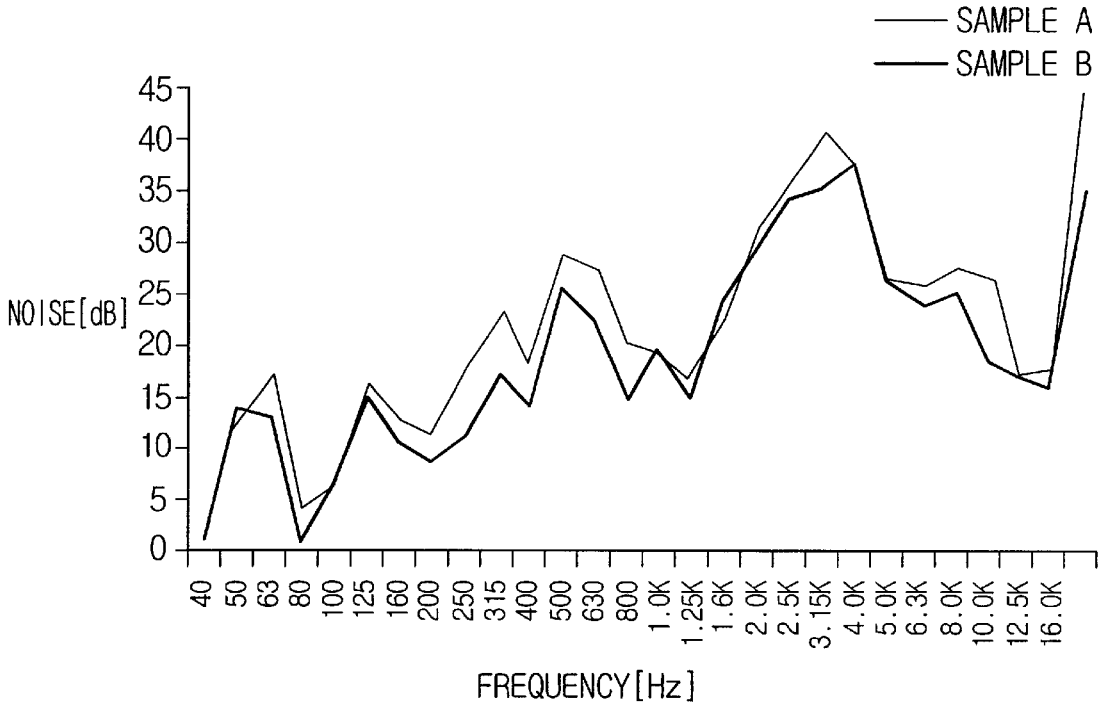
FIG. 5 is a graph for showing the comparison between a general hermetic compressor and the hermetic compressor of the present invention.

FIG. 5 is a graph illustrating the noise reductions respectively obtained from a conventional hermetic compressor (Sample A) and the hermetic compressor of the present invention (Sample B). The conventional hermetic compressor (Sample A) does not have any unit process portion 45 formed on the upper surface, while the hermetic compressor according to the present invention (Sample B) does. Below, Table 1 shows data about the noise level in the high frequency range which is generated from the upper surface of the upper shell 43.

TABLE 1

| | n1 | n2 | n3 | n4 | n5 | n6 | n7 | n8 | n9 | n10 | Average |
|---|---|---|---|---|---|---|---|---|---|---|---|
| Sample A [dB] | 46.0 | 48.0 | 47.0 | 48.0 | 45.5 | 49.5 | 49.0 | 46.0 | 47.0 | 46.0 | 47.2 |
| Sample B [dB] | 43.5 | 42.0 | 43.5 | 44.5 | | | | | | | 43.4 |

As indicated by the above Table 1 and graph of FIG. 5, the level of noise from the compressor that has the unit process portion 45 formed on the upper portion 43*c* is substantially less than the level of noise from the conventional compressor that does not have the unit process portion 45. It is also noticeable that the level of noise in the high frequency range of 3100 Hz to 3300 Hz is greatly reduced.

Meanwhile, as shown in FIG. 7, the compressor in accordance with the second preferred embodiment of the present invention also obtained a noise reduction effect, recording a noise level approximately below 2 dB, which is lower than the noise level of the conventional compressor.

This noticeable result is due to the increase in rigidity of the upper portion 43*c* of the upper shell 43 because of the unit process portion 45 that is formed in the upper portion 43*c* of the upper shell 43. The unit process portion 45 reduces the plane ratio of the upper portion 43*c*. More specifically, due to the presence of the unit process portion 45, the rigidity of the upper portion 43*c*, which is less rigid than the side and round portions 43*a* and 43*b*, respectively, is increased. Accordingly, the noise generated from the case 40 is controlled, since the noise generated from the inner portion the case 43 is prevented from being amplified or focused on the upper portion 43*c*.

Further, by reducing the noise in the high frequency range, the noise reduction in the low frequency range of 570 Hz, which is the main level where the cavity resonance occurs, is also controlled. As described above, reduction of noise in both the low frequency range as well as the high frequency range, greatly reduces the noise from compressors used in household appliances such as refrigerators and air conditioners or the like.

Further, as indicated in the Table 1 and the graph and table of FIGS. 5 and 7, the compressor of the present invention has reduced noise, and the degree of noise scattering is also reduced, while the CPK is improved. Accordingly, the overall estimation of error of the compressor as a final product can be reduced.

Further, since the noise level is decreased, the vibration of the case 40 also is diminished.

Although in the preferred embodiment of the invention the unit process portion 45 that is embossed on the upper shell 43 is in the shape of a half-moon, it is clearly understood that the half-moon shape is one of various shapes for the unit process portion. That is, the unit process portion 45 formed on the upper shell 43 may have various shapes, all of which will result in the same effect as the half-moon shaped protrusions.

As described above, in the hermetic compressor of the present invention, by embossing the unit process portion 45 in the upper portion 43*c* of the upper shell 43, abnormal noise, particularly high frequency noise generated from the upper portion of the upper shell 43, can be reduced. As a result, the degree of noise scattering is decreased, while the CPK is improved, and the error of the compressor eliminated or minimized.

Furthermore, since the noise in both the low and high frequency range is reduced, the quality of the compressor for household appliances, such as refrigerators, air conditioners, or the like, is improved.

What is claimed is:

1. A hermetic compressor comprising:

an electric drive portion having a rotor and a stator;

a compression portion for compressing a refrigerant, the compression portion being driven by a driving force from the electric drive portion; and a casing for enclosing the electric drive portion and the compression portion, the casing having at least one unit process portion which is processed to have a deformed surface; wherein the casing comprises:

a lower shell;

an upper shell connected to an upper end of the lower shell, the upper shell having a side portion of a cylindrical shape, an upper portion of a planar shape, and a round portion, the round portion having a predetermined radius of curvature and being connected between the side and upper portions, and the unit process portion being formed on the upper shell.

2. The compressor of claim 1, wherein the unit process portion is embossed from an upper portion of the casing to form an embossing of a predetermined depth in a certain pattern, the unit process portion increasing a rigidity of the casing and thereby reducing a level of noise generated from the electric drive portion and the compression portion during an operating of the compressor.

3. The compressor of claim 2, wherein the depth of the embossing ranges from approximately 5 mm to 15 mm.

4. The compressor of claim 2, wherein the depth of the embossing ranges from approximately 7 mm to 7.5 mm.

5. The compressor of claim 1, wherein the unit process portion comprises a plurality of protrusions formed around a rotary shaft of the rotor in a symmetrical manner.

6. The compressor of claim 1, wherein the unit process portion comprises a plurality of protrusions formed around a rotary shaft of the rotor in a direction of the rotation of the rotor.

7. The compressor of claim 1, wherein the unit process portion comprises a pair of half-moon protrusions formed around the rotor shaft of the rotor in a symmetrical manner.

8. The compressor of claim 1, wherein the unit process portion is formed within a diameter range of approximately 0.62–0.65, provided that the diameter of the side portion of the upper shell is 1 as a reference value.

9. The compressor of claim 1, wherein the unit process portion is formed within a radius of approximately 50 mm from the rotary shaft of the rotor.

10. The compressor of claim 1, wherein the unit process portion is processed to have a circular or polygonal shape from a front view.

11. The compressor of claim 1, wherein the unit process portion comprises a plurality of circular or polygonal shaped portions formed in a certain pattern when viewed from a front view.

* * * * *